United States Patent [19]

Walter

[11] 4,439,284

[45] Mar. 27, 1984

[54] COMPOSITION CONTROL OF ELECTRODEPOSITED NICKEL-COBALT ALLOYS

[75] Inventor: Robert J. Walter, Thousand Oaks, Calif.

[73] Assignee: Rockwell International Corporation, El Segundo, Calif.

[21] Appl. No.: 160,336

[22] Filed: Jun. 17, 1980

[51] Int. Cl.[3] ..... C25D 3/56

[52] U.S. Cl. ..... 204/43 T

[58] Field of Search ..... 204/43 T, 284

[56] References Cited

U.S. PATENT DOCUMENTS 3,300,396 1/1967 Walker ..... 204/49

4,062,755 12/1977 Turner ..... 204/275

OTHER PUBLICATIONS

J. W. Dini et al., "High Strength Nickel–Cobalt Deposits for Electrojoining Applications", Sandia Labs, pp. 56–64, Mar. 1973.

Abner Brenner, "Electrodeposition of Alloys", vol. I, pp. 146–149, (1963) and vol. II, pp. 260–261, (1963).

Duane W. Endicott et al., Plating, pp. 43–60, vol. 53, Jan. 1966.

C. B. F. Young et al., The Electrochemical Soc., pp. 289–298, Preprint 69–26, (1936), pp. 1–31, Preprint 89–1, (1946) and pp. 377–388, Preprint 72–25, (1937).

*Primary Examiner*—G. L. Kaplan

*Attorney, Agent, or Firm*—H. Fredrick Hamann; Harry B. Field

[57] ABSTRACT

A process for the preparation of electrodeposited nickel-cobalt comprises immersing an anode and a cathode into an electrolyte solution comprising a predetermined $Ni^{++}/Co^{++}$ ratio, passing a current from the anode to the cathode, and agitating the electrolytic solution in the area of the cathodic surface so as to prevent cathodic starvation and thereby eliminate the independent variables of current density and agitation.

5 Claims, 2 Drawing Figures

COMPOSITION CONTROL OF ELECTRODEPOSITED NICKEL-COBALT ALLOYS

BACKGROUND OF THE INVENTION

1. Field of the Invention

This invention pertains to electrochemistry and, more specifically, to composition control of electrodeposited nickel-cobalt.

2. Description of the Prior Art

Electrodeposited nickel-cobalt (EDNi-Co) alloys are attractive because of their high ambient temperature tensile properties. Codeposition of nickel-cobalt alloys has evolved from very hard, brittle deposits produced in Watts type nickel-cobalt sulfate and chloride electrolytes to ductile deposits produced in nickel-cobalt sulfamate electrolytes. The tensile properties of EDNi-Co are determined by the Ni-Co composition, which was thought to be controlled by the independent electrodeposition variables of current density, agitation rate, and electrolyte composition.

Endicott and Knapp in their paper entitled "Electrodeposits of Nickel-Cobalt Alloys", Plating January 1966, reported on their comprehensive investigation of the electrodeposition variables associated with codeposition of nickel-cobalt in sulfamate electrolytes. They showed that the alloy content was determined by the relative concentration of nickel-cobalt in the electrolyte and the deposit current density. The cobalt content decreased with increasing current density. Agitation is also an important variable controlling the nickel-cobalt ratio of the deposit. Dini, Johnson, and Helms in their report entitled "High Strength Nickel-Cobalt Deposits for Electroforming Applications", Sandia Laboratories, March 1973, observed for a sulfamate nickel-cobalt electrolyte ($Ni^{++}/Co^{++} \sim 10$) and 25 amps/sq. ft (asf) current density, that cobalt content was 28.5 percent with no agitation, 50 percent with moderate agitation, and 53.5 percent with vigorous agitation.

There have, however, been no investigations performed in which both agitation and current density were independently varied to determine any interrelationship or synergistic effects between current density, agitation, and cobalt content. For example, the influence of current density on deposit composition may be due to increasing concentration polarization with increasing current density and could, therefore, be prevented by adequate electrolyte agitation.

In this specification, EDNi-Co composition will be designated in terms of percent cobalt so that an alloy composition of 45% nickel and 55% cobalt would be written as EDNi-55Co. For cases where a significant composition gradient occurs over a given deposit thickness, the composition will still be designated in terms of percent cobalt. Thus, an alloy specimen which has a composition range of 50 to 55% cobalt would be identified as EDNi-50/55Co.

SUMMARY OF THE INVENTION

Accordingly, there is provided by the present invention a process for the preparation of high-strength electrodeposited nickel-cobalt which comprises passing a current from nickel and cobalt anodes to a cathode through an electrolyte comprising nickel and cobalt sulfamate, a boric acid buffer, and a wetting agent, and wherein the electrolyte adjacent to the cathode is vigorously agitated so as to prevent cobalt ion depletion (cathodic starvation) at the cathode surface. By providing the desired volumetric agitation, the previously-defined current density and agitation independent variables can be eliminated.

OBJECTS OF THE INVENTION

Therefore, it is an object of the present invention to provide high-strength EDNi-Co.

Another object of the present invention is to eliminate the independent processing variables of agitation and current density.

Still a further object of the present invention is to provide an EDNi-Co alloy having a uniform Ni-Co composition despite a non-uniform geometric surface which results in a non-uniform current density.

Yet a further object of the present invention is to provide an EDNi-Co alloy having uniformly small grain sizes.

Yet another object of the present invention is to provide a process for generating high-strength EDNi-Co.

Other objects, advantages and novel features of the present invention will become apparent from the following detailed description of the invention when considered in conjunction with the accompanying drawing.

DESCRIPTION OF THE PREFERRED EMBODIMENTS

Figure 1:
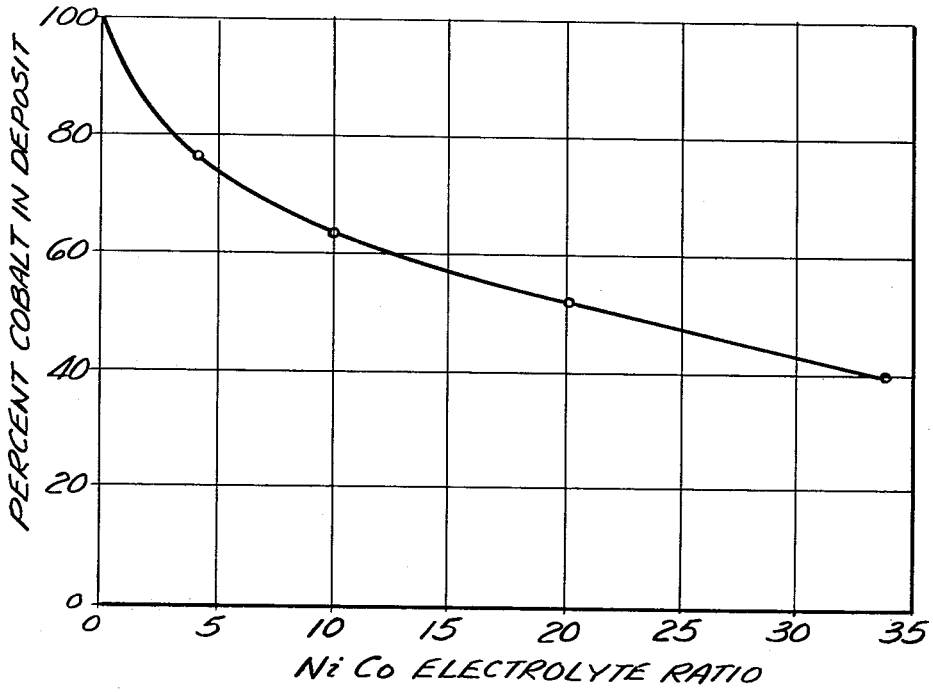
FIG. 1 is a graphical representation of percent cobalt in deposit versus Ni/Co electrolyte ratio.

In accordance with the present invention, there is provided a process for the electrodeposition of high-strength nickel-cobalt alloys. Basically, the system comprises a tank containing a nickel-cobalt electrolyte and an anode electrically connected through a power source to a cathodic substrate. The electrolyte of the present invention comprises nickel sulfamate, cobalt sulfamate, a buffer such as boric acid, and a wetting agent. It is important to note that in accordance with the present invention, and as shown in FIG. 1, it is the ratio of $Ni^{++}$ to $Co^{++}$ in the electrolyte which determines the ultimate composition of EDNi-Co and not current density, agitation, or how the nickel and cobalt ions are placed into the electrolyte. Thus, it can be seen that EDNi-65Co can be obtained from a $Ni^{++}/Co^{++}$ electrolyte ratio of about 10 and a EDNi-45Co alloy can be obtained from a $Ni^{++}/Co^{++}$ electrolyte ratio of about 30. Obviously, other alloy compositions can be obtained by maintaining other $Ni^{++}/Co^{++}$ ratios in the electrolyte.

The purpose of the anode is to keep the electrolyte composition constant. In the present invention, the anode comprises at least two non-reactive baskets preferably titanium, one of which exclusively contains nickel chips, and the other exclusively containing cobalt chips. Although it is preferred to have the anode baskets in pairs, any number of these anode baskets may be used provided that the system has at least one containing nickel and one containing cobalt, and that the nickel and cobalt chips are not intermixed. In the most preferred system there are two pairs of anode baskets arranged in alternating sequence within the electrolyte so as to obtain optimum dispersion.

In the present invention the anode baskets are connected to the cathodic substrate through separate conventional power sources or rectifiers, one for the basket(s) of nickel chips, and a second for the basket(s) of cobalt chips. By arranging the electronics in this manner, the electrolyte composition can be controlled. Thus, if it is desired to change the electrolyte composition, the individual anode currents can be adjusted until the desired $Ni^{++}/Co^{++}$ ratio is reached.

Figure 2:
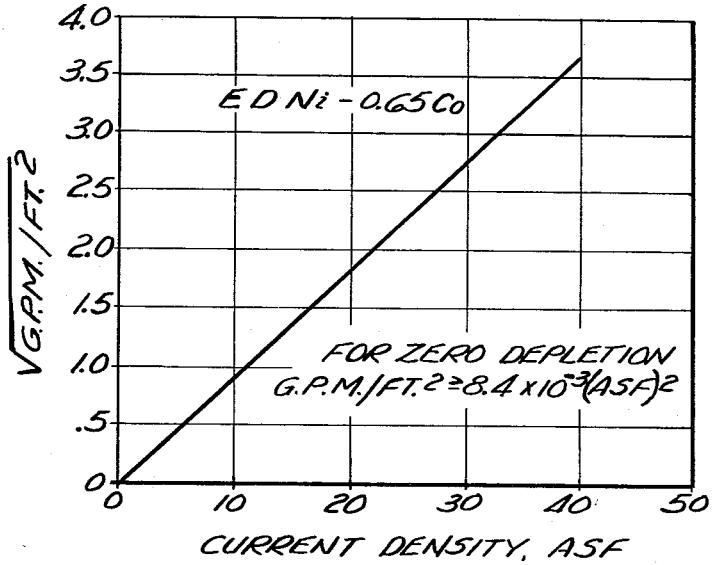
FIG. 2 is a graphical representation of electrolyte flow rate needed to prevent $Co^{++}$ depletion at the cathode versus current density in amps/sq.ft (asf).

Added to the above system is a means for agitating the electrolyte in the vicinity of the cathodic substrate. The agitation which was previously defined as an independent variable has now been found to be dependent upon current density only until a certain minimum volumetric flow rate has been obtained. The minimum volumetric flow rate needed to prevent cathodic starvation is called the cathodic starvation agitation level. Once the minimum electrolyte flow rate is reached, cathodic starvation can be eliminated, and thus the previously-defined agitation independent variable is eliminated. Similarly, this allows current density to be varied so as to adjust electrodeposition rate without changing alloy composition. As shown in FIG. 2, as the current density is increased, the flow rate or agitation required to prevent cathodic starvation similarly increases. Therefore, should it be found that cathodic starvation is occurring during the process, one may either increase agitation or decrease current density.

The high strength EDNi-Co alloys are obtained by preparing deposits in the range of from about 35% to about 65% cobalt. In this range, the grain size of the EDNi-Co remains extremely small, and thus the resulting material derives the desired physical properties. Although cobalt deposition in the range of about 35% to about 65% will provide a high-strength product with good grain size, a preferred range for cobalt deposition is from about 40 to about 55% cobalt and the most preferred range is from about 45 to about 55% cobalt. By way of example and not limitation, EDNi-65Co can be obtained by maintaining an electrolytic solution $Ni^{++}/Co^{++}$ ratio of about 10, a current density of about 40 amps/square foot, and an agitation of about 13.5 gpm/ft$^2$ of cathodic surface. FIG. 2 shows the curve depicting the electrolyte flow needed to prevent $Co^{++}$ depletion at the cathode (cathodic starvation) versus current density with an electrolyte $Ni^{++}/Co^{++}$ ratio of 10. Tests show that a set of curves such as the one depicted in FIG. 2 can be established for the various $Ni^{++}/Co^{++}$ ratios. In these situations, as the $Ni^{++}/Co^{++}$ ratio in the electrolyte is increased, the amount of cobalt electroplated out of the electrolyte decreases. Tests have shown that in the range of about 40 to about 77% cobalt (FIG. 1), zero $Co^{++}$ depletion can be obtained when the cathodic starvation agitation level is maintained above about gpm/ft$^2 = 8.4 \times 10^{-3}$(asf)$^2$.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A process for controlling the composition of electrodeposited nickel-cobalt, EDNi-Co, comprises the steps of:

immersing an anode comprising at least one non-reactive basket containing nickel, and at least one non-reactive basket containing cobalt, and a cathodic substrate into an electrolyte having a predetermined $Ni^{++}/Co^{++}$ ratio;

controlling said predetermined electrolyte $Ni^{++}/Co^{++}$ ratio constant by passing a current from said nickel anode to said cathodic substrate through a first power source or rectifier and by passing a current from said cobalt anode to said cathodic substrate through a second power source or rectifier: and agitating the electrolyte in the vicinity of said cathodic substrate above the cathodic starvation agitation level.

2. The process of claim 1 wherein said EDNi-Co has a cobalt range from about 35 to about 65 percent cobalt.

3. The process of claim 2 wherein said EDNi-Co has a cobalt range from about 40 to about 55 percent cobalt.

4. The process of claim 3 wherein said EDNi-Co has a cobalt range from about 45 to about 55 percent cobalt.

5. The process of claim 1 wherein said cathodic starvation agitation level is gpm/ft$^2 \geqq 8.4 \times 10^{-3}$(asf)$^2$.

* * * * *